US006955221B2

(12) United States Patent
Bursaux

(10) Patent No.: US 6,955,221 B2
(45) Date of Patent: Oct. 18, 2005

(54) ACTIVE HEATING OF THERMALLY INSULATED FLOWLINES

(75) Inventor: Gabriel André Bursaux, Houston, TX (US)

(73) Assignee: Stolt Offshore Inc., Houston, TX (US)

( * ) Notice: Subject to any disclaimer, the term of this patent is extended or adjusted under 35 U.S.C. 154(b) by 25 days.

(21) Appl. No.: 10/445,119

(22) Filed: May 23, 2003

(65) Prior Publication Data

US 2004/0040716 A1 Mar. 4, 2004

Related U.S. Application Data

(60) Provisional application No. 60/385,243, filed on May 31, 2002.

(51) Int. Cl.[7] ..... E21B 36/00
(52) U.S. Cl. ..... 166/303; 166/61
(58) Field of Search ..... 166/57, 61, 302, 166/303; 138/114, 149

(56) References Cited

U.S. PATENT DOCUMENTS

| | | | | | |
|---|---|---|---|---|---|
| 2,911,047 | A | * | 11/1959 | Henderson | 166/61 |
| 3,626,987 | A | | 12/1971 | Bittner | 138/114 |
| 3,955,601 | A | | 5/1976 | Plummer, III | 138/149 |
| 5,853,031 | A | | 12/1998 | de Oliveira | 138/149 |
| 5,979,506 | A | * | 11/1999 | Aarseth | 138/33 |
| 6,082,391 | A | | 7/2000 | Thiebaud et al. | |
| 6,145,547 | A | | 11/2000 | Villatte | |
| 6,328,074 | B1 | * | 12/2001 | Wright et al. | 138/137 |
| 6,509,557 | B1 | * | 1/2003 | Bass | 219/772 |
| 6,588,500 | B2 | * | 7/2003 | Lewis | 166/61 |
| 6,776,227 | B2 | * | 8/2004 | Beida et al. | 166/61 |

FOREIGN PATENT DOCUMENTS

| | | |
|---|---|---|
| FR | 2 746 891 | 10/1997 |
| GB | 0 784 699 | 11/1957 |
| GB | 1081889 | 9/1967 |
| GB | 1141014 | 1/1969 |
| GB | 2 325 292 | 11/1998 |
| WO | WO 02/053869 A1 | 7/2001 |
| WO | WO 02/063128 A1 | 8/2002 |
| WO | WO 03/085312 A1 | 10/2003 |

OTHER PUBLICATIONS

L. D. Brown et al.; "Design of Britannia's Subsea Heated Bundle for a 25 Year Service Life"; *1999 Offshore Technology Conference* held in Houston, Texas, May 3–6, 1999. OTC 11017.

J.E. Smith; "Challenges of the Britannia Subsea Development"; *1999 Offshore Technology Conference* held in Houston, Texas, May 3–6, 1999. OTC 11016.

* cited by examiner

*Primary Examiner*—Zakiya Walker
(74) *Attorney, Agent, or Firm*—Sheridan Ross P.C.

(57) ABSTRACT

Hydrocarbon liquids are transported from a subsea welihead to an above-surface hydrocarbon processing facility along a pipe-in-pipe flowline. The flowline is a pipe placed coaxially within an outer carrier pipe and the annulus between the pipes is filled with thermally insulating material. The hydrocarbon liquids have their temperature maintained above solidification/precipitation temperature by heat from an active heating system. Hot liquid, preferably hot water, is passed along the annulus, either along a single pipe or multiple pipes installed in the insulation-filled annulus, or along an inner annulus formed by a water pipe added concentrically around the hydrocarbon-transporting inner pipe, inside the outer insulation-filled annulus. The water or other suitable liquid can be heated in a heater at or adjacent the subsea wellhead, or by a water heater in the above-surface hydrocarbon processing facility.

16 Claims, 3 Drawing Sheets

ACTIVE HEATING OF THERMALLY INSULATED FLOWLINES

CROSS REFERENCE TO RELATED APPLICATION

This application claims priority from U.S. Provisional Patent Application No. 60/385,243 filed in May 31, 2002. The entire disclosure of the provisional application is considered to be part of the disclosure of the accompanying application and is hereby incorporated by reference.

This invention relates to active heating of thermally insulated flowlines, and relates more particularly to the active supply of heat to hydrocarbons in hydrocarbon-transporting flowlines of the pipe-in-pipe type.

BACKGROUND OF THE INVENTION

In the development and exploitation of submarine hydrocarbon reservoirs, subsea wells are commonly used to extract the hydrocarbon fluids which can then be transported through submarine flowlines to above-surface hydrocarbon processing facilities at sea or on land. Depending on the characteristics of the hydrocarbon fluids, it may be necessary to maintain the temperature of the hydrocarbon fluids being transported in the flowline above a specific temperature thereby to prevent the flowline becoming blocked due to the solidification of wax, hydrates, or asphaltenes. The temperature of the hydrocarbon fluids in the flowline is normally maintained by surrounding the external surface of the flowline with a covering of material that has good thermal insulation properties. Depending on the level of thermal insulation required, this flowline covering can range from an external coating of polymer (e.g. polypropylene) to a pipe-in-pipe system, wherein the hydrocarbon-transporting pipe is placed coaxially within an outer carrier pipe and the annulus between the pipes is filled with thermally insulating material.

It is noted that conduits for hydrocarbons have previously been encased along parts of their length, either for simple bundling and/or for structural support. The term "pipe-inpipe" as used herein refers to a class of double-walled conduits with very high insulation performance, where inner and outer conduits are pre-formed into a rigid unit with a sealed annular space between the inner and outer conduits. The pipe-in-pipe conduit may be assembled from pre-formed pipe-in-pipe sections, or assembled from separate inner and outer pipe section directly into a longer pipe-in-pipe unit.

The pipe-in-pipe flowline may be arranged horizontally on the seabed, or may form part of a riser or riser tower of the type described in U.S. Pat. No. 6,082,391 [Stolt-Doris], or in copending international application WO 02/53869A [63752WO], not published at the present priority date. The pipe-in-pipe flowline may be formed as described in French Patent FR 2746891 (assigned to ITP), including provision of reduced gas pressure to improve insulation. The pipe-in-pipe flowline may be formed with an auxiliary conduit as described in application PCT/EP03/04178[64054WO], also not published at the present priority date. The contents of all these applications are incorporated herein by reference, especially for their teaching of pipe-in-pipe products and fabrication techniques.

The compositions of the hydrocarbon fluids found in some submarine reservoirs, particularly in the deep waters of the Gulf of Mexico, West Africa and Brazil, require thermal insulation values beyond those available from conventional pipe-in-pipe systems. During the operation of a subsea hydrocarbon field, the wells linking the reservoir to the above-surface hydrocarbon processing facility are often required to be closed, thus leaving non-flowing hydrocarbon fluids in the flowline. During these shut-in conditions the fluids are dependent on the thermal insulation system to maintain their temperature above that at which blockages may form. Under these shut-in conditions, even conventional pipe-in-pipe systems may not be able to provide sufficient thermal insulation to maintain the temperature of the hydrocarbons above that at which flowline blockages will occur, especially for a shut-in of extended duration.

SUMMARY OF THE INVENTION

It is therefore an object of the invention to provide a flowline heating system and a heated flowline that will obviate or mitigate the inadequacies of prior art arrangements.

According to a first aspect of the invention there is provided a method of actively heating hydrocarbon liquids contained in a hydrocarbon-transporting pipe-in-pipe flowline whose annulus contains thermally insulating material and/or a partial vacuum for high insulation performance, the method comprising the step of passing hot liquid along the annulus. The hot liquid is preferably water.

According to a second aspect of the invention there is provided an active heating system for the active supply of heat to hydrocarbon liquids in a hydrocarbon-transporting flowline of the pipe-in-pipe type wherein a hydrocarbon-transporting pipe is placed coaxially within an outer carrier pipe and the annulus between the pipes is filled with thermally insulating material, the active heating system comprising conduit means extending along the annulus, the conduit means being adapted to carry hot liquid. The hot liquid is preferably water.

The invention includes an active hot water heating system for a pipe-in-pipe submarine flowline system, with the hot water system included within the carrier pipe. The hot water can either be supplied from the above-surface hydrocarbon process facility and pumped towards the subsea wellhead, or the hot water can be supplied from a subsea water heater near the subsea wellhead and pumped towards the above-surface process facilities. The water may be substituted by other suitable liquids.

It is thus proposed to supplement the hydrocarbon-temperature-sustaining thermal insulation properties of pipe-in-pipe systems with an additional active heating system disposed within the outer carrier pipe. The present invention enables the active heating to be provided by a hot water system located within the outer carrier pipe, with the water provided by the processing facilities or a via a water heating system located at the well end of the flowline and energised by power from a platform or other installation that is the flowline destination (or a flowline waystation). This will allow the pipe-in-pipe concept to be used in more aggressive hydrocarbon fluid conditions by enabling the production and relatively trouble-free transport of a wider range of hydrocarbon fluids than could be reliably carried in unheated flowlines. The pipe-in-pipe concept also provides a method of keeping the fluids warm during shut-in conditions, and is expected to prove more cost effective and reliable than electrical active heating systems which have been used previously since steel pipe (for carrying heating liquid) is basically cheaper than copper cable, there is no reliance on contact between electrical cable and the flowline, and liquid heating systems obviate the risk of localised over-heating in electrical heating systems that could cause excessive gas expansion and eventual explosion. The hot water system can also be used as a remedial measure in the event of a hydrocarbon flowline becoming internally blocked, e.g. by the formation of solid hydrate or a wax plug. In this eventuality, the heat from the hot water system will be applied along the length of the flowline to melt the hydrate or wax plug. This use of heat as an unblocking procedure is a very cost-effective alternative to the very difficult procedure of trying to find the location of a blockage within a flowline, and then either applying localised heat, or cutting out and removing the blocked section, or fabricating a bypass flowline around the blockage. Suitable liquids can be substituted for the heating water.

BRIEF DESCRIPTION OF THE DRAWINGS

Embodiments of the invention will now be described by way of example only, with reference to the accompanying drawings wherein.

Common reference signs will be used for corresponding parts, with prefix "1", "2", "3" in the corresponding figures.

DETAILED DESCRIPTION OF PREFERRED EMBODIMENTS

Figure 1:
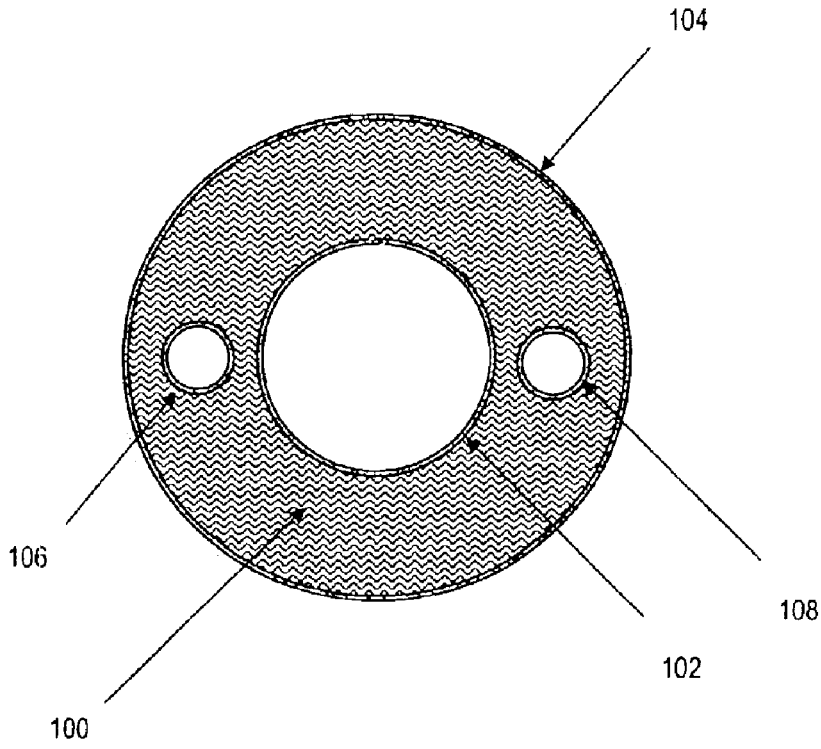
FIG. 1 is a schematic cross-section of a first embodiment of the invention.

Referring first to FIG. 1, this shows the schematic transverse cross-section of a pipe-in-pipe ("p-i-p") thermally insulated hydrocarbon-transporting flowline wherein hot hydrocarbon liquids (or hydrocarbon liquid/gas mixtures) are transported along the inner pipe, and are thermally insulated by an annular blanket of thermally insulating material 100 substantially filling the annulus between the inner hydrocarbon-transporting flowline pipe 102 and the concentric outer carrier pipe 104. A hot water input pipe 106 is located radially mid-way between the inner and outer pipes, and extends along the length of the pipe-in-pipe flowline. Diametrically opposite the hot water input pipe 108, a hot water return pipe is located radially mid-way between the inner and outer pipes, and extends along the length of the pipe-in-pipe flowline.

The pipe may be made in double walled sections or assembled from inner and outer pipe sections as described in co-pending applications of associated companies cited in the introduction and incorporated herein by reference.

Figure 2:
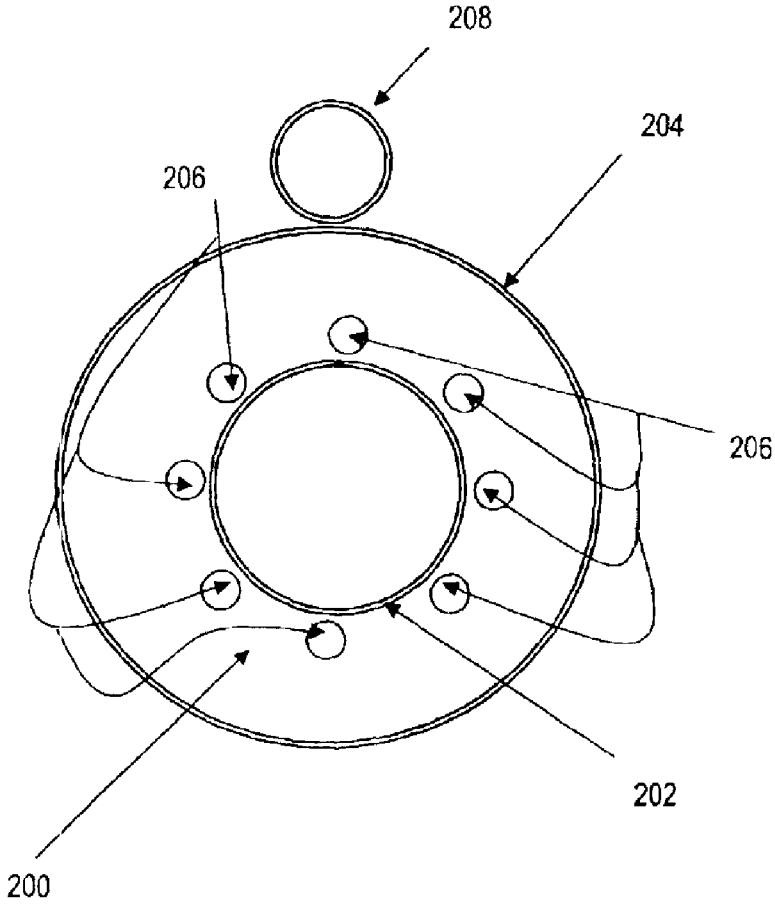
FIG. 2 is a schematic cross-section of a second embodiment of the invention.

In the basic arrangement shown in FIG. 1:

1. the active heat input is provided by a single hot water supply pipe 106 embedded within the insulation material 100 in the annulus between the inner hydrocarbon flowline 102 and the outer carrier pipe 104, the supply pipe 106 extending the full length of the pipe-in-pipe flowline;
2. after actively supplying heat to sustain a blockage-inhibiting temperature in the inner pipe, the used heating water is returned to a water heater (not shown) through a return pipe 108 (or discharge pipe) embedded within the thermal insulation material filling the annulus within the outer carrier pipe;
3. the return pipe 108 can be omitted if the used heating water is discharged from the flowline directly into the sea at the far end of the flowline; and
4. the return pipe 108 could alternatively be mounted outside of the carrier pipe in a "piggy-back" arrangement (see also FIG. 2 described below).

Referring now to FIG. 2, this shows a modification of the pipe-in-pipe arrangement of FIG. 1, in which:

1. the active heat input is provided by a plurality of circumferentially spaced-apart hot water supply pipes 206 embedded within the insulation material (hatching omitted for clarity) in the annulus between the inner hydrocarbon flowline 202 and the outer carrier pipe 204, the supply pipes extending the full length of the pipe-in-pipe flowline;
2. the plurality of hot water supply pipes are in this example located in the radially innermost part of the annulus, i.e. next to the outer surface of the hydrocarbon-transporting inner pipe 202, and these supply pipes could be wound in a helical formation along the axis of the hydrocarbon flowline;
3. after actively supplying heat to sustain a blockage-inhibiting temperature in the inner pipe, the used heating water is returned to the water heater through a single return pipe 208 piggy-backed to the exterior of the outer carrier pipe;
4. the return pipe 208 can be omitted if the used heating water is discharged directly into the sea at the far end of the flowline; and
5. the return pipe 208 (or plural pipes) could alternatively be embedded in the annulus within the outer carrier pipe (as in the FIG. 1 arrangement).

Figure 3:
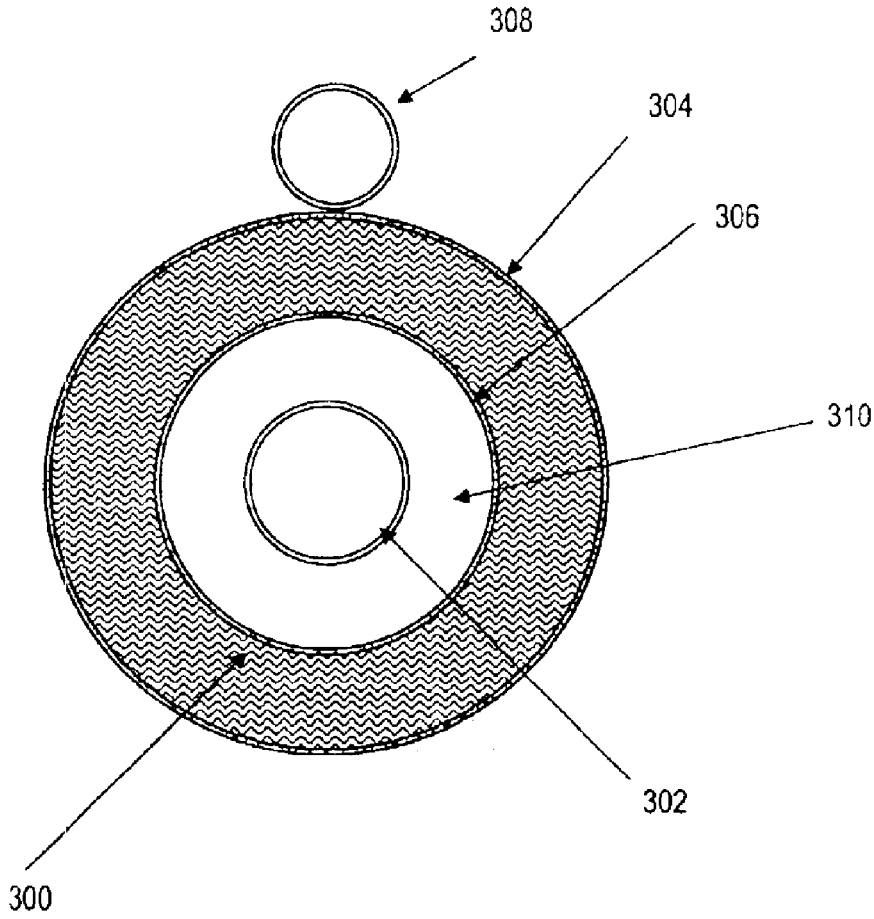
FIG. 3 is a schematic cross-section of a third embodiment of the invention.

Referring now to FIG. 3, this shows the schematic transverse cross-section of a triple concentric pipe-in-pipe-in-pipe hydrocarbon flowline with thermal insulation and active heating. Whereas the FIG. 2 arrangement was the FIG. 1 arrangement modified by multiplying the number of hot water supply pipes and distributing them around the innermost hydrocarbon-transporting pipe, the FIG. 3 arrangement is a modification of the FIG. 2 arrangement in which the hot water supply pipes are merged into a single large-diameter pipe forming a hot water-filled annulus around the innermost hydrocarbon-transporting pipe.

In the FIG. 3 arrangement:

1. the hydrocarbon-transporting 302 pipe is concentrically located inside an inner carrier pipe 306, with hot water 307 passing through the annulus between the hydrocarbon-transporting pipe 302 and the inner carrier pipe 306, and the annulus between the inner carrier pipe and the outer carrier pipe is filled with thermally insulating material 300;
2. after actively supplying heat to sustain a blockage-inhibiting temperature in the inner pipe 302, the used heating water is returned to the water heater through a single return pipe 308 piggy-backed to the exterior of the outer carrier pipe;
3. the return pipe 308 can be omitted if the used heating water is discharged directly into the sea at the far end of the flowline; and
4. the return pipe 308 could alternatively be embedded in the thermally insulating material, for example within the outer annulus between the inner and outer carrier pipes 306, 304.

The active heating system of the present invention can be applied in subsea oilfield developments where fluid chemistry issues are important. This is the case for virtually all deepwater oilfield developments and many marginal oilfields in the North Sea.

In carrying out the invention and having regard to cost/efficiency ratios, the preferred liquid for active heating is substantially pure water, i.e. water that is clean, mineral-free, de-ionised and pH-neutral. However, the invention can be performed with other liquids, including but not restricted to water that is relatively impure, i.e. water that is not perfectly clean and mineral-free; with suitable precautions against corrosion and encrustation, raw seawater could be used, with consequently reduced cost in open-circuit heating systems. The invention can also be performed with non-aqueous liquids, e.g. with suitable hydrocarbons (normally in closed-circuit heating systems) and possibly with the produced hydrocarbons carried by the pipeline (or with a separated fraction of the produced hydrocarbons) tapped from the pipeline (via a fraction separator if fractionation is required), heated, and circulated along the heating channel(s).

While certain alternative exemplary forms of the invention have been described above together with potential modifications and variations thereof, the invention is not restricted thereto, and other modifications and variations can be adopted without departing from the spirit and scope of the invention as defined in the appended claims.

What is claimed is:

1. A method of actively heating hydrocarbon liquids contained in a hydrocarbon-transporting pipe-in-pipe flowline comprising a hydrocarbon-transporting pipe placed coaxially within an outer carrier pipe, a space between said pipes defining an annulus and containing at least one of a thermally insulating material and partial vacuum, the method comprising the steps of passing hot liquid along the annulus and returning the initially hot liquid, after use, along a return conduit to a heating means for the hot liquid, wherein the return conduit is located outside the carrier pipe and piggy-backed thereto.

2. A method as claimed in claim 1, including the further step of confining the hot liquid to a conduit during passage of the hot liquid along the annulus.

3. A method as claimed in claim 2 wherein the hot liquid is passed along a single conduit extending alongside the hydrocarbon-transporting pipe.

4. A method as claimed in claim 2 wherein the hot liquid is passed along a plurality of conduits extending alongside the hydrocarbon-transporting inner pipe.

5. A method as claimed in claim 1 wherein the hot liquid is water.

6. An active heating system for the active supply of heat to hydrocarbon liquids in a hydrocarbon-transporting flowline of the pipe-in-pipe type wherein a hydrocarbon-transporting pipe is placed coaxially within an outer carrier pipe and the annulus between the pipes is filled with thermally insulating material, the active heating system comprising at least one heating conduit extending along the annulus, the at least one heating conduit being adapted to carry hot liquid;

a return conduit for returning initially hot liquid, after use, to a heating means for heating the liquid; and wherein the return conduit comprises a pipe located outside the outer carrier pipe and piggy-backed thereto.

7. An active heating system as claimed in claim 6 wherein the heating conduit comprises a pipe.

8. An active heating system as claimed in claim 7 wherein the at least one heating conduit is helically disposed around the hydrocarbon-transporting inner pipe.

9. An active heating system as claimed in claim 6 wherein the heating conduit comprises a plurality of pipes that are circumferentially distributed around the annulus.

10. An active heating system as claimed in claim 6 wherein the heating conduit comprises a pipe disposed concentrically around the hydrocarbon-transporting inner pipe and concentrically within the insulation-filled annulus.

11. An active heating system as claimed in claim 6 comprising a liquid discharge means for discharging the initially hot liquid into the sea around the flowline after use of the initially hot liquid.

12. An active heating system as claimed in claim 6 wherein the hot liquid is water.

13. The combination of an active heating system as claimed in claim 6 with a liquid heating means.

14. A combination as claimed in claim 13 wherein the liquid heating means is a liquid heater located at or adjacent to a subsea wellhead from which hydrocarbon liquids are transported by the flowline to which the active heating system is applied.

15. A combination as claimed in claim 13, wherein the liquid heating means is a water heater located within an above-surface hydrocarbon processing facility to which hydrocarbon liquids are transported by the flowline to which the active heating system is applied.

16. A combination as claimed in claim 15 when installed between a subsea wellhead and a conventional above-surface hydrocarbon processing facility including a water heater that is employed as the water heater for heating the water used in the active heating system.

* * * * *